US008807709B2

(12) United States Patent
Ooishi et al.

(10) Patent No.: US 8,807,709 B2
(45) **Date of Patent: *Aug. 19, 2014**

(54) INK-JET HEAD AND METHOD OF MANUFACTURING INK-JET HEAD

(75) Inventors: Naoki Ooishi, Mishima (JP); Hiroyuki Kushida, Odawara (JP); Minoru Koyata, Mishima (JP); Masashi Seki, Sunto-gun (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 33 days.

This patent is subject to a terminal disclaimer.

(21) Appl. No.: 13/411,726

(22) Filed: Mar. 5, 2012

(65) Prior Publication Data

US 2012/0229577 A1 Sep. 13, 2012

(30) Foreign Application Priority Data

Mar. 11, 2011 (JP) ..... 2011-054386

(51) Int. Cl.
*B41J 2/045* (2006.01)

(52) U.S. Cl.
USPC ..... 347/68; 347/71; 347/72; 347/69

(58) Field of Classification Search
USPC ..... 347/68–72
See application file for complete search history.

(56) References Cited

U.S. PATENT DOCUMENTS

| | | | | |
|---|---|---|---|---|
| 5,578,418 | A * | 11/1996 | Noguchi et al. | 430/280.1 |
| 8,534,804 | B2 * | 9/2013 | Ooishi | 347/68 |
| 2008/0158305 | A1 * | 7/2008 | Cha et al. | 347/68 |
| 2012/0229578 | A1 * | 9/2012 | Koyata et al. | 347/71 |

FOREIGN PATENT DOCUMENTS

| | | | | |
|---|---|---|---|---|
| JP | 2009-202473 | * | 9/2009 | B41J 2/16 |

* cited by examiner

*Primary Examiner* — Henok Legesse
(74) *Attorney, Agent, or Firm* — Amin, Turocy & Watson, LLP

(57) ABSTRACT

According to one embodiment, an ink-jet head includes a substrate, a piezoelectric member, electrically conductive portions, a frame member, an insulating film, an electronic component and a protective agent. The piezoelectric member is mounted on the substrate and includes pressure chambers. The electrically conductive portions extend from the pressure chambers and are disposed on the substrate. The frame member inside which the piezoelectric member is disposed is attached to the substrate from above the electrically conductive portions. The insulating film covers the piezoelectric member, the frame member, and a part of the electrically conductive portions. The electronic component is connected to the electrically conductive portions. The protective agent covers an end portion of the insulating film located between the frame member and the electronic component and the electrically conductive portions between the electronic component and the end portion of the insulating film.

8 Claims, 3 Drawing Sheets

INK-JET HEAD AND METHOD OF MANUFACTURING INK-JET HEAD

CROSS-REFERENCE TO RELATED APPLICATIONS

This application is based upon and claims the benefit of priority from the prior Japanese Patent Application No. 2011-054386, filed on Mar. 11, 2011, the entire contents of which are incorporated herein by reference.

FIELD

Embodiments described herein relate generally to an ink-jet head and a method of manufacturing the ink-jet head.

BACKGROUND

An ink-jet head of a so-called end-shooter type comprises a substrate, piezoelectric member mounted on the substrate, frame member, and nozzle plate. The substrate, frame member, and nozzle plate are affixed in layers. An ink chamber to be supplied with ink is defined inside the frame member, and the piezoelectric member is accommodated in the ink chamber.

The piezoelectric member comprises a plurality of groove-like pressure chambers to be supplied with the ink. Electrodes are disposed in the pressure chambers, individually, and are connected individually to a plurality of wiring patterns on the substrate. A driver IC for controlling the ink-jet head is connected to the wiring patterns. If the driver IC applies a voltage to the electrodes in the pressure chambers through the wiring patterns, the piezoelectric member undergoes a shear-mode deformation such that the ink in the pressure chambers can be discharged.

To prevent corrosion of electrically conductive portions or a short circuit, an insulating film is formed on the electrodes in the pressure chambers and the wiring patterns on the substrate. In forming the insulating film, those portions to which the driver IC is connected are masked with, for example, grease.

After the insulating film is formed, that part of it on the grease is removed. The driver IC is connected to the wiring patterns exposed by the masking. On the other hand, the wiring patterns are left exposed between the driver IC and an end portion of the insulating film. Thus, exposed parts of the wiring patterns may be degraded.

DETAILED DESCRIPTION

In general, according to one embodiment, an ink-jet head includes a substrate, a piezoelectric member, a plurality of electrically conductive portions, a frame member, an insulating film, an electronic component and a protective agent. The piezoelectric member is mounted on the substrate and includes a plurality of pressure chambers. The electrically conductive portions extend from the pressure chambers, individually, and are disposed on the substrate. The frame member inside which an ink chamber in which the piezoelectric member is disposed is defined is attached to the substrate from above the electrically conductive portions. The insulating film covers the piezoelectric member, the frame member, and a part of the electrically conductive portions. The electronic component is connected to the electrically conductive portions. The protective agent covers an end portion of the insulating film located between the frame member and the electronic component and the electrically conductive portions between the electronic component and the end portion of the insulating film.

Figure 1:
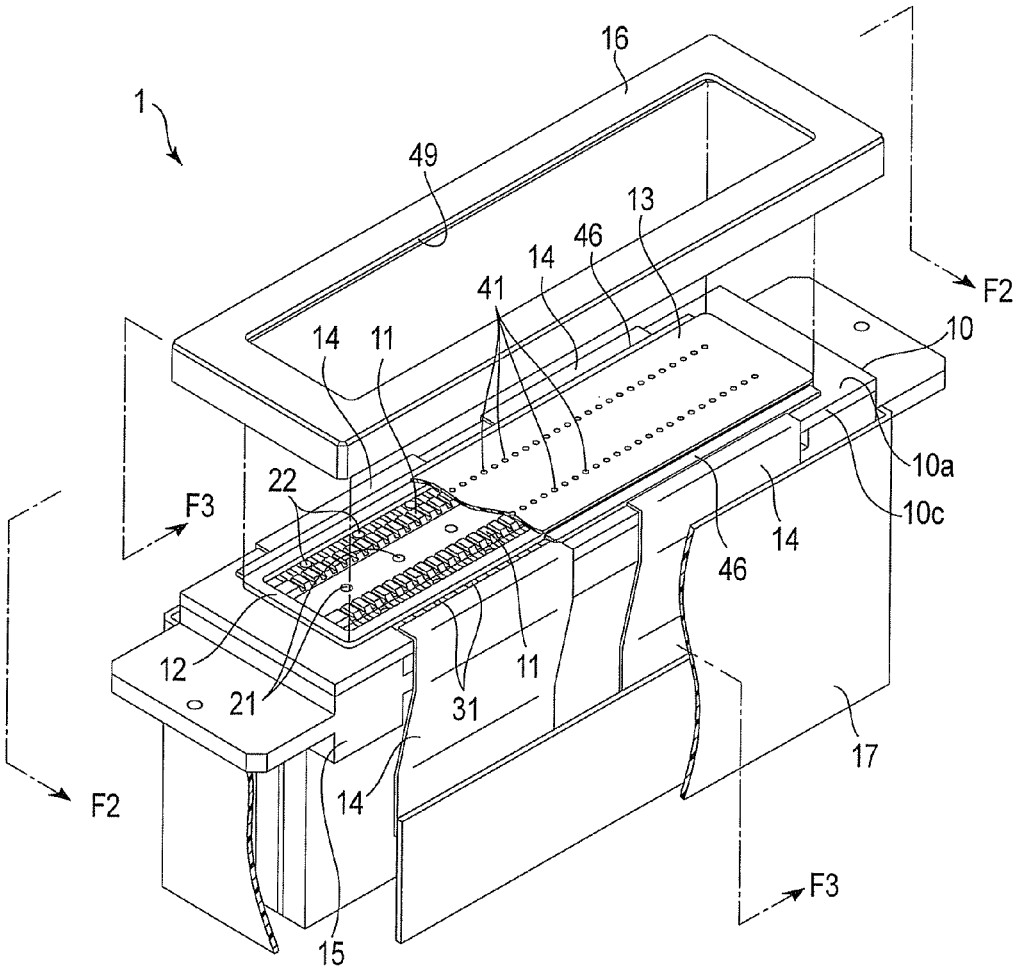
FIG. 1 is an exploded perspective view showing an ink-jet head according to a first embodiment.
Figure 2:
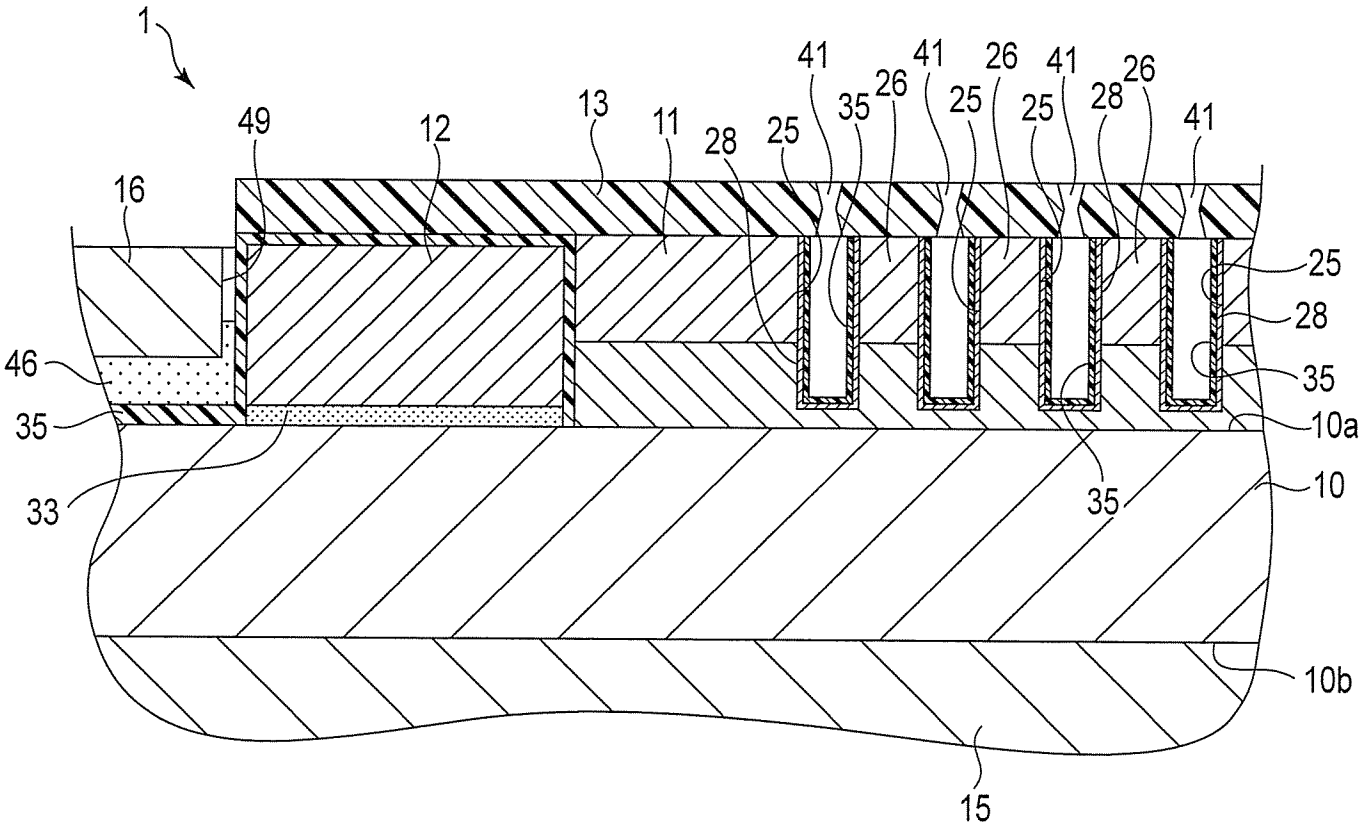
FIG. 2 is a sectional view of the ink-jet head of the first embodiment taken along line F2-F2 of FIG. 1.
Figure 3:
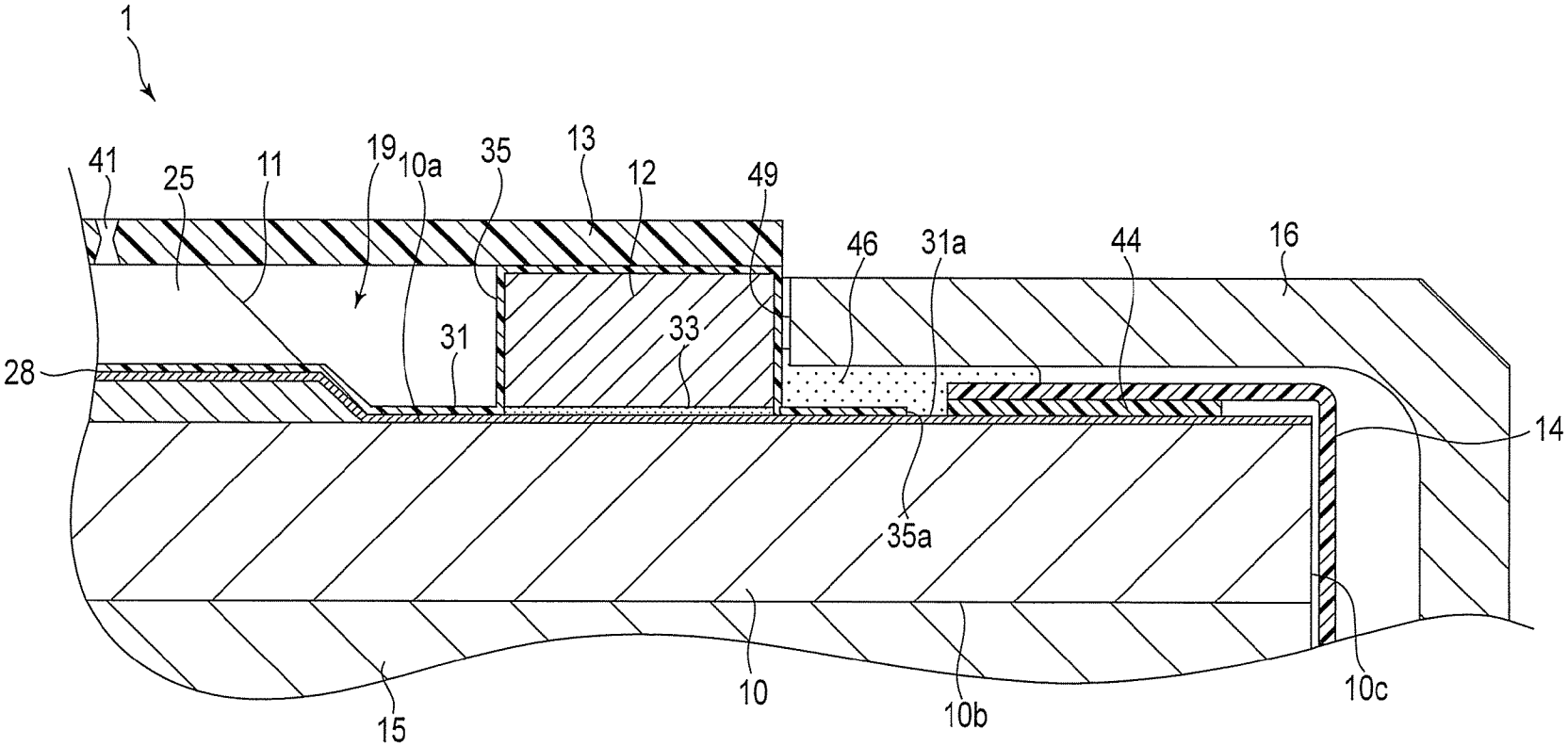
FIG. 3 is a sectional view of the ink-jet head of the first embodiment taken along line F3-F3 of FIG. 1.

A first embodiment will now be described with reference to FIGS. 1 to 3. FIG. 1 is a cutaway exploded perspective view showing an ink-jet head 1. FIG. 2 is a partial sectional view of the head 1 taken along line F2-F2 of FIG. 1. FIG. 3 is a partial sectional view of the head 1 taken along line F3-F3 of FIG. 1.

As shown in FIG. 1, the ink-jet head 1 is of a so-called side-shooter type. The head 1 comprises a substrate 10, a pair of piezoelectric members 11, frame member 12, nozzle plate 13, a plurality of driver ICs 14, manifold 15, mask 16, and cover 17. Each driver IC 14 is an example of an electronic component.

As shown in FIG. 3, an ink chamber 19 to be supplied with ink is defined inside the frame member 12. The ink chamber 19 is closed by the substrate 10 and nozzle plate 13. The pair of piezoelectric members 11 are located within the ink chamber 19.

The substrate 10 is a rectangular plate of a ceramic, such as alumina. The substrate 10 has a flat first surface 10*a* and a second surface 10*b* on the opposite side to it. The second surface 10*b* is attached to the manifold 15. As shown in FIG. 1, the substrate 10 comprises a plurality of ink supply ports 21 and a plurality of ink discharge ports 22.

The ink supply ports 21 are disposed in, the central part of the substrate 10 such that they are arranged longitudinally relative to the substrate 10. The ink supply ports 21 individually open into the ink chamber 19. When the substrate 10 is attached to the manifold 15, the ink supply ports 21 are connected to an ink tank through the manifold 15. Ink in the ink tank is introduced into the ink chamber 19 through the ink supply ports 21.

The ink discharge ports 22 are arranged in two rows such that they sandwich the ink supply ports 21 between them. The ink discharge ports 22 individually open into the ink chamber 19. When the substrate 10 is attached to the manifold 15, the ink discharge ports 22 are individually connected to the ink tank through the manifold 15. The ink in the ink chamber 19 is recovered into the ink tank through the ink discharge ports 22.

The pair of piezoelectric members 11 are individually mounted on the first surface 10*a* of the substrate 10 and extend longitudinally relative to the substrate 10 and parallel to each other. The piezoelectric members 11 are individually disposed between the ink supply ports 21 and ink discharge ports 22.

Each of the piezoelectric members 11 is formed by affixing two piezoelectric plates of, for example, lead zirconate titanate (PZT) together such that their polarization directions are opposite. Each piezoelectric member 11 is in the form of a bar having a trapezoidal cross-section.

As shown in FIG. 2, each piezoelectric member 11 comprises a plurality of pressure chambers 25 that communicate with the ink chamber 19. The pressure chambers 25 are grooves that extend across the piezoelectric member 11.

The ink introduced into the ink chamber 19 through the ink supply ports 21 is delivered to the pressure chambers 25. The ink passed through the pressure chambers 25 is recovered into the ink tank through the ink discharge ports 22.

Column portions 26 are formed individually between the pressure chambers 25. The column portions 26 divide the pressure chambers 25 and form side surfaces of the pressure chambers 25, individually.

Electrodes 28 are disposed in the pressure chambers 25, individually. Each electrode 28 covers the side and bottom surfaces of its corresponding pressure chamber 25. Although each electrode 28 is formed of, for example, a thin nickel film, it may alternatively be formed of a gold or copper film, for example. Each electrode 28 is, for example, 2 to 5 μm thick. The column portions 26, having the electrodes 28 formed on their opposite side surfaces, are used as driving elements.

As shown in FIG. 3, a plurality of wiring patterns 31 are arranged on the first surface 10*a* of the substrate 10. Each wiring pattern 31 is an example of an electrically conductive portion. The wiring patterns 31 are formed by, for example, laser-patterning a thin nickel film formed on the first surface 10*a* of substrate 10. Each wiring pattern 31 is, for example, 2 to 5 μm thick. The wiring patterns 31 are located ranging from side edges 10*c* of the substrate 10 to the piezoelectric members 11 and connected to the electrodes 28, individually.

The frame member 12 is attached to the first surface 10*a* of the substrate 10 from above the wiring patterns 31 using an adhesive 33. The frame member 12 surrounds the pair of piezoelectric members 11, ink supply ports 21, and ink discharge ports 22.

The adhesive 33 is sandwiched between the substrate 10 and frame member 12. The adhesive 33 is, for example, 30 μm thick. For example, the adhesive 33 is an epoxy-resin adhesive, which is resistant to ink and thermosetting. Alternatively, the adhesive 33 may be, for example, a silicone or acrylic adhesive. The resistance of the adhesive to ink implies that the adhesive strength can be kept at 50 kg/cm$^2$ even when the adhesive is immersed in ink for an assumed period of use of 6 to 12 months.

An insulating film 35, which is electrically insulating and resistant to ink, is disposed on the substrate 10, piezoelectric members 11, and frame member 12. The insulating film 35 (not shown in FIG. 1) covers the electrodes 28, part of the wiring patterns 31, part of the first surface 10*a* of the substrate 10, part of the second surface 10*b* of the substrate 10, frame member 12, and piezoelectric members 11. The insulating film 35 may be configured to cover some other portion or portions. The insulating film 35 is, for example, 3 to 10 μm thick. The electrodes 28 are protected by the insulating film 35 from ink introduced into the pressure chambers 25. Further, the wiring patterns 31 are protected by the insulating film 35 from the ink introduced into the ink chamber 19.

The insulating film 35 is cut in regions around the side edges 10*c* of the substrate 10. Thus, each wiring pattern 31 comprises an exposed portion 31*a* that is exposed by virtue of not being covered by the insulating film 35. The exposed portion 31*a* defines that part of the wiring pattern 31 which is not covered by the insulating film 35, and can be covered by some member other than the insulating film 35.

The insulating film 35 consists mainly of, for example, a para-xylene polymer. Specifically, a paraxylylene polymer, such as Parylene-C (poly-chloro-para-xylylene), Parylene-N (poly-para-xylylene), or Parylene-D (poly-dichloro-para-xylylene), is available as this polymer material. Alternatively, the insulating film 35 may be formed using some other material, such as polyimide.

The nozzle plate 13 is formed of a rectangular film of polyimide. The nozzle plate 13 may be formed from a material other than polyimide that can undergo laser micro-processing.

The nozzle plate 13 is mounted on the frame member 12 from above the insulating film 35 that covers the frame member 12. The nozzle plate 13 is bonded to the top of each piezoelectric member 11 and closes the pressure chambers 25.

The nozzle plate 13 comprises a plurality of nozzles 41. The nozzles 41, which correspond to the pressure chambers 25, individually, are arranged side by side and longitudinally relative to the nozzle plate 13. The nozzles 41 open into the pressure chambers 25, individually.

The driver ICs 14 are connected to the respective exposed portions 31*a* of the wiring patterns 31 in the vicinity of an end portion 35*a* of the insulating film 35. The driver ICs 14 are flexible printed circuit boards for controlling the ink-jet head 1. The location of the driver ICs 14 is not limited to the end portion 35*a* of the insulating film 35.

Each driver IC 14 is thermocompression-bonded to the wiring patterns 31 by an anisotropic conductive film (ACF) 44. Alternatively, each driver IC 14 may be connected to the wiring patterns 31 by some other means than the ACF 44, such as an anisotropic conductive paste (ACP), nonconductive film (NCF), or nonconductive paste (NCP). Each driver IC 14 is, for example, 35 μm thick. Likewise, the ACF 44 is 35 μm thick, for example.

Based on a signal input from a controller of an ink-jet printer, the driver ICs 14 apply a voltage to the electrodes 28 through the wiring patterns 31. The column portions 26 supplied with voltage through the electrodes 28 undergo a shear-mode deformation, thereby pressurizing the ink introduced into the pressure chambers 25. The pressurized ink is discharged from the corresponding nozzles 41.

As shown in FIG. 3, the end portion 35*a* of the insulating film 35 is located outside the frame member 12. In other words, the end portion 35*a* of the insulating film 35 is located between the frame member 12 and driver ICs 14. The insulating film 35 is formed ranging from the central part of the first surface 10*a* of the substrate 10 to the regions around the side edges 10*c* of the substrate 10 through a region above the frame member 12. In this case, the insulating film 35 ranges from the, central part of the first surface 10*a* of the substrate 10 to either of the side edges 10*c*.

A protective agent 46 is disposed ranging from the frame member 12 to the driver ICs 14. The protective agent 46 covers and seals the end portion 35*a* of the insulating film 35. The protective agent 46 covers the exposed portions 31*a* of the wiring patterns 31 between the driver ICs 14 and the end portion 35*a* of the insulating film 35.

The protective agent 46, like the adhesive 33, for example, is an epoxy-resin adhesive resistant to ink and thermosetting. Alternatively, the protective agent 46 may be, for example, a silicone or acrylic adhesive. Further, the protective agent 46 may be an adhesive of a type different from the adhesive 33.

The protective agent 46 adheres to the side surfaces of the frame member 12. Further, the protective agent 46 adheres to each driver IC 14 such that it covers a part of the IC 14. Thus, the protective agent 46, along with the ACF 44, secures the driver IC 14 to the main body 10.

As shown in FIG. 1, the mask 16 is in the form of a frame comprising an opening 49 in which the frame member 12 and nozzle plate 13 are fitted. As shown in FIG. 3, the nozzle plate 13 projects outside the opening 49.

The mask 16 covers the exposed portions 31*a* of the wiring patterns 31 and the driver ICs 14 connected to the exposed portions 31*a*. The mask 16 is attached to the first surface 10*a* of the substrate 10 by the protective agent 46, an adhesive. The protective agent 46 closes a gap between the frame member 12 and mask 16.

As shown in FIG. 1, the cover 17 is in the form of an open-ended box. The cover 17 accommodates various components, including the manifold 15 and driver ICs 14. A housing of the ink-jet head 1 is formed by mounting the cover 17.

The following is a description of an example of a method of manufacturing the ink-jet head 1 constructed in this manner. First, the ink supply and discharge ports 21 and 22 are formed by press forming in the substrate 10, which is an unfired ceramic sheet (ceramic green sheet). Thereafter, the substrate 10 is fired.

Then, the pair of piezoelectric members 11 are formed by, for example, affixing two piezoelectric plates together with a thermosetting adhesive. The piezoelectric members 11 are attached to the substrate 10 with, for example, a thermosetting adhesive. The piezoelectric members 11 are positioned on the substrate 10 by means of a jig and mounted on the substrate. Subsequently, the respective corner portions of the piezoelectric members 11 are, so to speak, tapered. Thereupon, the cross-section of each piezoelectric member 11 becomes trapezoidal.

Then, the pressure chambers 25 are formed in the piezoelectric members 11. The pressure chambers 25 are defined by cutting the piezoelectric members 11 by means of, for example, a diamond wheel of a dicing saw, which is used to cut IC wafers.

Subsequently, the electrodes 28 are formed in the pressure chambers 25, individually, and at the same time, the wiring patterns 31 are formed on the first surface 10*a* of the substrate 10. The electrodes 28 and wiring patterns 31 are formed from, for example, a thin nickel film by electroless plating. Then, patterning is performed by laser irradiation, whereupon the thin nickel film is removed from regions other than the electrodes 28 and wiring patterns 31.

Then, the frame member 12 is attached to the main body 10 with the adhesive 33. The adhesive 33 is applied to the frame member 12 by, for example, screen printing. The frame member 12 is bonded to the main body 10 from above the wiring patterns 31.

Then, the insulating film 35 is formed by chemical vapor deposition (CVD). When this is done, the regions around the side edges 10*c* of the first surface 10*a* of the substrate 10 and other portions that are not covered by the insulating film 35 are protected with a masking tape, e.g., a polyimide tape. The masking tape is removed after the insulating film 35 is formed. Thus, the respective exposed portions 31*a* of the wiring patterns 31 are formed that are exposed by virtue of not being covered by the insulating film 35.

Then, the nozzle plate 13 that is not yet formed with the nozzles 41 is affixed to the top of each piezoelectric member 11 and the frame member 12 from above the insulating film 35. An ink-repellent film is previously formed on the nozzle plate 13 by means of, for example, a bar coater. The nozzles 41 are formed by applying an excimer laser beam to the nozzle plate 13 mounted on the frame member 12.

Subsequently, the driver ICs 14 are thermocompression-bonded to the exposed portions 31*a* of the wiring patterns 31 with the ACF 44. The driver ICs 14 are electrically connected to the wiring patterns 31 through the ACF 44.

Then, the protective agent 46 is applied between the frame member 12 and driver ICs 14 by means of, for example, a dispenser. The protective agent 46 is applied onto the end portion 35*a* of the insulating film 35, thereby sealing the end portion 35*a*. The respective exposed portions 31*a* of the wiring patterns 31 between the driver ICs 14 and the end portion 35*a* of the insulating film 35 are covered by the protective agent 46.

Then, the mask 16 is attached to the substrate 10 in such a manner that the frame member 12 and nozzle plate 13 are fitted in the opening 49. The mask 16 is secured to the substrate 10 by the protective agent 46 that is applied ranging from the frame member 12 to the driver ICs 14.

Subsequently, the second surface 10*b* of the substrate 10 is attached to the manifold 15. Finally, the cover 17 is fitted on the manifold 15 and driver ICs 14, whereupon manufacturing processes for the ink-jet head 1 shown in FIG. 1 are accomplished. The thermosetting adhesive used in the manufacturing processes for the ink-jet head 1 may be either thermally cured every time one member is mounted or thermally cured at a time in a stage.

According to the ink-jet head 1 constructed in this manner, the end portion 35*a* of the insulating film 35 is covered by the protective agent 46. Therefore, the insulating film 35 is prevented from starting to peel off at the end portion 35*a*, or the ink from the end portion 35*a* is prevented from penetrating between the insulating film 35 and wiring patterns 31. Since the protective agent 46 seals the end portion 35*a* of the insulating film 35, moreover, the ink is prevented from adhering to the end portion 35*a*.

The protective agent 46 covers the exposed portions 31*a* of the wiring patterns 31 between the driver ICs 14 and the end portion 35*a* of the insulating film 35 located outside the frame member 12. Thus, the ink is prevented from adhering to the exposed portions 31*a* even if it is introduced to the vicinity of the driver ICs 14 as it leaks from an ink supply tube or creeps up during maintenance, for example. Consequently, the ink is prevented from corroding the wiring patterns 31 or causing a short circuit. The conductive wiring patterns 31 are protected in this way.

The insulating film 35 is formed after the frame member 12 is attached to the substrate 10 and covers the frame member 12. Thus, the insulating film 35 is formed in a relatively late process, among other manufacturing processes for the ink-jet head 1, so that degradation of the insulating film 35 by heat produced as the adhesive is thermally cured is suppressed. Consequently, the ink is kept from contacting the electrodes 28 and wiring patterns 31 due to degradation of the insulating film 35.

The protective agent 46 is an ink-resistant adhesive. Therefore, the exposed portions 31*a* of the wiring patterns 31 between the driver ICs 14 and the end portion 35*a* of the insulating film 35 is easily covered by applying the protective agent 46 by means of the dispenser. Since the protective agent 46 is an adhesive of the same type as the adhesive 33, moreover, an increase in the manufacturing cost of the ink-jet head 1 is suppressed.

The mask 16 is attached to the substrate 10 by the protective agent 46. In other words, the protective agent 46 is used as an adhesive in attaching the mask 16 to the substrate 10. Thus, an increase in the manufacturing cost of the ink-jet head 1 is suppressed.

The protective agent 46 adheres to the driver ICs 14. Thus, the protective agent 46, along with the ACF 44, secures the driver ICs 14 to the main body 10, thereby preventing the driver ICs 14 from separating from the wiring patterns 31.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An ink-jet head comprising:

a substrate;

a piezoelectric member mounted on the substrate and comprising a plurality of pressure chambers;

a plurality of electrodes disposed in the pressure chambers, individually;

a plurality of electrically conductive portions disposed on the substrate and connected to the electrodes, individually;

a frame member inside which an ink chamber in which the piezoelectric member is disposed is defined and which is attached to the substrate from above the electrically conductive portions;

an insulating film which covers the piezoelectric member, the electrodes, the frame member, and a part of the electrically conductive portions;

an electronic component connected to the electrically conductive portions;

a protective agent which entirely covers an end portion of the insulating film located between the frame member and the electronic component and the electrically conductive portions between the electronic component and the end portion of the insulating film;

the end portion of the insulating film is sealed by the protective agent;

the protective agent is an ink resistant adhesive; and a mask which is attached to the substrate by the protective agent, thereby covering the electronic component.

2. The ink-jet head of claim 1, wherein the protective agent closes a gap between the frame member and the mask.

3. The ink-jet head of claim 1, wherein the protective agent adheres to the electronic component.

4. The ink-jet head of claim 3, wherein the electronic component is a driver IC.

5. The ink-jet head of claim 1, wherein the frame member is attached to the substrate by an adhesive, and the protective agent is an adhesive of the same type as the adhesive for the frame member.

6. The ink-jet head of claim 1, wherein the protective agent is disposed over a distance greater than a distance between the end portion of the insulating film and the electronic component.

7. The ink-jet head of claim 1 ,further comprising a nozzle plate which is attached to the frame member from above the insulating film, closes the ink member, and comprises a plurality of nozzles opening into the pressure chambers, individually.

8. An ink-jet head comprising:

a substrate;

a piezoelectric member mounted on the substrate and comprising a plurality of pressure chambers;

a plurality of electrically conductive portions extending from the pressure chambers, individually, and disposed on the substrate;

a frame member inside which an ink chamber in which the piezoelectric member is disposed is defined and which is attached to the substrate from above the electrically conductive portions;

an insulating film which covers the piezoelectric member, the frame member, and a part of the electrically conductive portions;

an electronic component connected to the electrically conductive portions;

a protective agent which entirely covers an end portion of the insulating film located between the frame member and the electronic component and the electrically conductive portions between the electronic component and the end portion of the insulating film;

the end portion of the insulating film is sealed by the protective agent;

the protective agent is an ink resistant adhesive; and a mask which is attached to the substrate by the protective agent, thereby, covering the electronic component.

* * * * *